United States Patent [19]

Groppetti et al.

[11] Patent Number: 4,581,536

[45] Date of Patent: Apr. 8, 1986

[54] RADIATION DETECTION TUBE HAVING SPURIOUS RADIATION SHIELD

[75] Inventors: Claudio C. Groppetti, Plymouth; Brian R. Stinger, Minneapolis; James M. Celt, Mounds View; Theodore E. Larsen, Edina, all of Minn.

[73] Assignee: Detector Electronics Corp., Minneapolis, Minn.

[21] Appl. No.: 472,042

[22] Filed: Mar. 4, 1983

[51] Int. Cl.[4] ..... H01J 47/02

[52] U.S. Cl. ..... 250/385; 250/374

[58] Field of Search ..... 250/385, 374; 313/93

[56] References Cited

U.S. PATENT DOCUMENTS

| | | | |
|---|---|---|---|
| 2,084,865 | 6/1937 | Penning et al. | 313/540 |
| 2,397,071 | 3/1946 | Hare | 313/93 |
| 2,461,254 | 2/1949 | Bassett | 250/226 |
| 2,500,941 | 3/1950 | Friedman | 313/93 |
| 2,601,334 | 6/1952 | Siegert | 250/375 |
| 2,913,610 | 11/1959 | Henderson | 313/544 |
| 3,014,147 | 12/1961 | Morton | 313/527 |
| 3,019,364 | 1/1962 | Krohs et al. | 313/524 |
| 3,333,145 | 7/1967 | Nielson | 315/10 |
| 3,344,302 | 9/1967 | Engh et al. | 313/538 |
| 3,771,005 | 11/1973 | Erickson | 313/538 |
| 3,787,745 | 1/1974 | Wulms | 313/529 |
| 4,307,130 | 12/1981 | Van Geest et al. | 427/70 |
| 4,376,893 | 3/1983 | Whetten | 250/374 |

*Primary Examiner*—Alfred E. Smith
*Assistant Examiner*—Constantine Hannaher
*Attorney, Agent, or Firm*—Paul L. Sjoquist

[57] ABSTRACT

Radiation detection tube having a glass envelope surrounding an anode and cathode, and having a further conductive surface surrounding a portion of the glass envelope in the region of the anode-cathode gap, the exterior conductor electrically coupled to the anode.

8 Claims, 3 Drawing Figures

RADIATION DETECTION TUBE HAVING SPURIOUS RADIATION SHIELD

BACKGROUND OF THE INVENTION

This invention relates to a radiation detection device, and more specifically to a radiation detection tube having a conductive external surface for minimizing spurious detection of secondary radiation. The invention is related to radiation sensitive, gaseous discharge detectors of the Geiger-Mueller type, capable of operating at low voltages and having high current carrying capacity.

A radiation detector of the Geiger-Mueller type has an anode and a cathode placed in a medium comprising an ionizable gas, and which, upon being subjected to radiation to which it is sensitive, causes electrons to be ejected from the cathode, which electrons are then accelerated toward the anode. The accelerating electrons collide with gas atoms, thereby ionizing the gas and releasing further electrons, which accommodate the flow of current between the anode-cathode electrodes. The current is subsequently monitored and controlled via external circuitry. One of many such control schemes is described here. When the current reaches a specified level the external circuits electrically short the anode to cathode which allows the ionized gas to return to the neutral state. A voltage is then reapplied to the anode, enabling the detector to further respond to radiation that may be present. The number of such gas discharge events per unit of time provides a measure of the amount of radiation incident upon the tube, and external circuits are utilized to count and otherwise record these discharge events.

One such radiation detector of the Geiger-Mueller type is described in U.S. Pat. No. 2,461,254, issued Feb. 8, 1949. Another patent in the prior art which discloses a similar Geiger-Mueller type detector is U.S. Pat. No. 2,500,941, issued Mar. 21, 1950. A further patent disclosing a similar invention is U.S. Pat. No. 3,344,302, issued Sept. 26, 1967. These patents generally disclose anode-cathode relationships, enclosed in a gaseous medium, with a glass envelope surrounding the components and medium, so as to provide electrical signals representative of radiation incident upon the device.

There has always been a problem with these and other prior art devices with respect to the detection of spurious secondary radiation. Spurious secondary radiation is defined as radiation that is capable of producing a discharge in the previously mentioned devices which is initiated by radiation from sources other than sources that the device was designed to respond to; i.e., the ultraviolet component of solar radiation. Attempts have long been made at minimizing this spurious secondary radiation, and it has been thought that the solution to the problem resides in the proper design of the anode/-cathode configuration and the electrode to glass spacing, together with the proper selection of the electrode materials and fill gases used for these components. It was felt that spurious secondary radiation could be controlled, or at least minimized, by proper selection of these design parameters, and previous attempts at minimizing spurious secondary radiation have been directed in these areas.

The present invention results from the discovery that the spectral response is derived not only from the configuration described above, but also from the glass envelope of the device to an extent not previously known.

Large spacing of the electrodes from the internal walls of the device had been thought to be an adequate measure to eliminate the influence of the glass surfaces. Upon discovery that this is not reliable under all operating conditions of the device, and that it is influenced by the electrostatic history of the tube, the factors which might influence or limit the extent of the glass spectral response were investigated. It is believed that the spectral response of the glass is due to the photoelectron emission of the glass from what is known as "electron traps" or "acceptor states" in the glass. The acceptor states are believed to be intrinsic in the glass, or they may be due to the various process steps involved in manufacturing the tube, or both.

Williams has described an experiment wherein light illumination of $SiO_2$ layers caused the release of electrons trapped in the $SiO_2$, in a study he made of the transporting and trapping properties of electrons in $SiO_2$ layers. This experiment is summarized in a paper entitled "Internal Photoemission as a Tool for the Study of Insulators," by Alvin M. Goodman. The paper is found at page 99 of *Optical Properties of Dielectric Films,* published by the Dielectrics and Insulation Division of the Electrochemical Society, Inc., New York, N.Y. (1968). The Goodman paper discusses this process, which it refers to as "internal photoemission;" i.e. the photoemission of mobile electrons or holes into an insulator from an adjacent conducting medium. Goodman provides six different examples of the internal photoemission process, and it is believed that at least some of these examples contribute to the understanding of how acceptor states in glass may be populated with electrons. Acceptor states can be populated with electrons naturally, or they can be populated by the abundance of electrons available during the operation of the tube. Once these acceptor states are populated, it is then possible to have photoelectron emission from the glass, and it is believed that this photoelectron emission is a principal cause of the spurious secondary radiation commonly detected by such devices.

The present invention is primarily concerned with radiation detectors responding to ultraviolet radiation whose wavelength is below the ultraviolet component of solar radiation. It is believed that radiation in this range, as well as radiation whose wavelength is in the ultraviolet component of solar radiation begins the process of photoelectron emission when such radiation passes through the glass. When electrons are produced from the glass, according to this mechanism, they may be injected into the interior of the tube, and may accelerate toward the anode and cause spurious counts.

When a voltage potential is applied to the glass envelope it has been found to have a direct effect on the secondary photoelectron emission process. Applying a voltage potential which is negative in the same sense as the cathode voltage has been found to increase the amount of spurious secondary radiation present and detected by the tube. Applying a zero voltage potential, or grounding the glass envelope, has also been found to increase the spurious radiation detected. Further, it has been found that applying a fixed positive voltage potential to the glass envelope produces different but equally unacceptable results. Experimentation has shown that the best results are achieved when the voltage potential applied to the glass envelope is made to follow the anode voltage, which varies during operation of the detector, and the present invention relates to an apparatus for accomplishing this result.

BRIEF DESCRIPTION OF THE INVENTION

The invention comprises a radiation detection tube having a glass envelope and an internal anode and cathode properly spaced in a gaseous medium, and further includes a circumferential conductive element external to the glass envelope and positioned in the region of the anode-cathode gap, wherein this external conductive element is electrically connected to the anode voltage potential.

It is therefore a principal object of the present invention to minimize spurious radiation detection in radiation detection devices.

It is yet another object of the invention to provide a conductive layer circumferentially surrounding at least a portion of the glass envelope to control the factors causing spurious radiation.

These and other objects will become apparent from the following specification and claims, and with reference to the appended drawings.

DESCRIPTION OF THE PREFERRED EMBODIMENT

Figure 1:
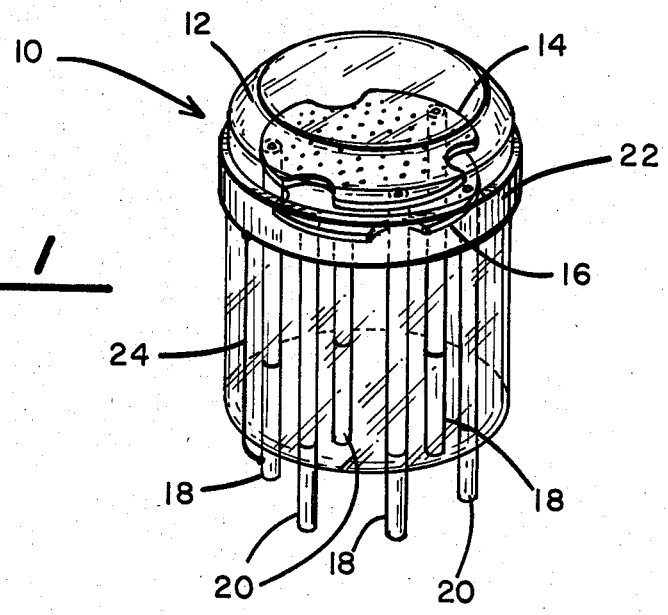
FIG. 1 shows an isometric view of a radiation detection tube incorporating the invention therein.
Figure 2:
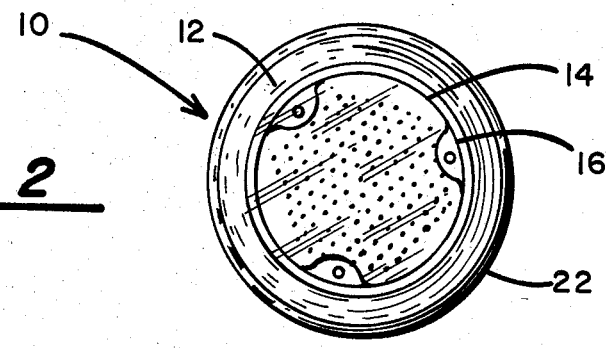
FIG. 2 shows a top view of the tube of FIG. 1.
Figure 3:
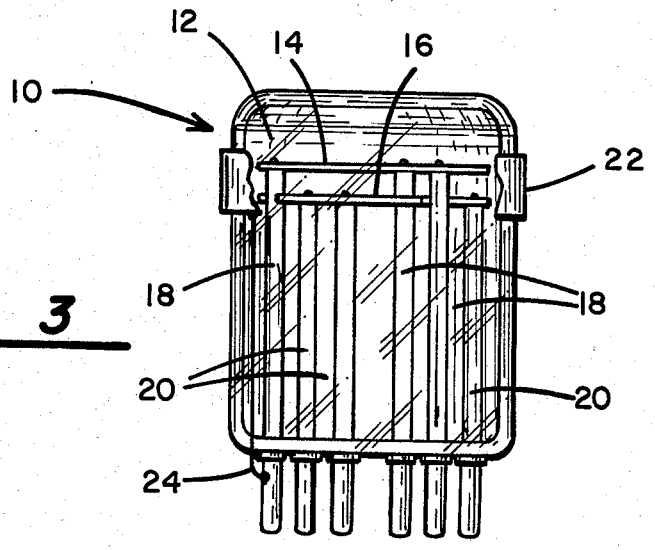
FIG. 3 shows an elevation view of the tube of FIG. 1.

Referring to the drawings, there is shown a radiation detection tube 10 having a glass envelope 12 completely surrounding and encasing an anode 14 and a cathode 16. Anode 14 has a plurality of pins 18 which provide mechanical support and stable positioning for anode 14. Pins 18 and anode 14 are electrically conductive, and pins 18 project externally of glass envelope 12. Cathode 16 and anode 14 are constructed from materials which are selected for a particular spectral response. Typical materials are molybdenum, tungsten and nickel. Pins 18 and 20 may or may not be selected from these same materials.

Cathode 16 is spaced a predetermined distance from anode 14, and is mechanically stabilized by pins 20, which project externally of glass envelope 12. Cathode 16 and pins 20 are made from electrically conductive material.

In a preferred embodiment anode 14 and cathode 16 are circular planar elements held in a fixed and predetermined spatial relationship, and have a gap therebetween whose dimension is precisely controlled. The internal region of glass envelope 12 is filled with an ionizable gas, typically a mixture of neon with other gaseous components known in the art.

A conductive band 22 is circumferentially applied about the external surface of glass envelope 12. Conductive band 22 may be formed of a copper foil having conductive adhesive around the glass envelope, or may be formed in other equivalent ways. For example, conductive band 22 may be applied by means of sputtering techniques, vapor deposition, or other techniques commonly known in the art. A conductor 24 is electrically connected to conductive band 22, and is also electrically connected to anode 14 via an anode pin 18. Conductor 24 may also be connected in any of a number of other ways to provide the necessary electrical connection between anode 14 and conductive band 22. For example, conductor 24 may be designed as a further pin projecting from radiation detection tube 10 for insertion into a socket in a circuit board, and the electrical connection between conductive band 22 and anode 14 may be made via circuits external to the radiation detection tube.

In the preferred embodiment conductive band 22 has a width of approximately one-half inch, and is circumferentially placed so as to bridge the anode-cathode gap region around glass envelope 12. Conductive band 22 preferably extends at least a short distance above the plane of anode 14, and may extend a distance below the plane of cathode 16. It has been found that the area adjacent the anode-cathode electrodes is the most critical area to be encompassed by conductive band 22, although it may also be possible to apply a conductive film over the entire envelope exterior surface, so long as the radiation transmission characteristics of the glass envelope are not seriously degraded. It has been found in tests that the desirable effects described herein are reduced somewhat when the conductive band is applied to the envelope at positions which do not intersect with the planar extension of the anode and cathode elements. Conductive band 22 may be covered by an insulating layer such as rubber or plastic, to thereby electrically shield the conductive band.

In operation, the cathode of radiation detection tube 10 is typically placed at or near ground potential, and a positive voltage in the range of 250–350 volts is applied to anode 14. Anode 14 is typically spaced from cathode 16 a distance of 0.38–0.64 millimeters, and the interior of radiation detection tube 10 is filled with a gas principally comprising neon, or with a neon/hydrogen mixture, or with other equivalent gases. Radiation detection tube 10 is placed in a radiation environment so that external radiation incident upon the glass envelope of the tube passes through the glass envelope and into the region between the anode and cathode. The gas discharge events previously described herein take place as a result of this incident radiation, and the conductive band surrounding the external surface of the glass envelope prevents other and secondary radiation effects from influencing the gas discharge events and from otherwise causing spurious radiation detection.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed is:

1. In a radiation detection tube having a glass envelope surrounding an anode and cathode in a gaseous mixture, the improvement comprising a conductive band on the exterior of said glass envelope in the region of said anode and cathode; and an electrical conductor coupling said conductive band to said anode.

2. The improvement of claim 1, wherein said conductive band is positioned to bridge the gap between said anode and cathode.

3. A radiation detection tube comprising (a) an anode element;

(b) a cathode element parallel to said anode and at a predetermined spacing from said anode;

(c) a generally cylindrical glass envelope surrounding said anode and cathode;

(d) a conductive band circumferentially affixed to the external surface of said glass envelope in the region of said anode-cathode spacing; and (e) a conductor electrically connecting said conductive band to said anode.

4. The apparatus of claim 3 wherein said conductive band is constructed sufficiently wide to bridge the gap between said anode and said cathode.

5. The apparatus of claim 4, further comprising at least one conductive pin supporting said anode element and projecting externally of said glass envelope.

6. The apparatus of claim 5, further comprising at least one conductive pin supporting said cathode element and projecting externally of said glass envelope.

7. The apparatus of claim 4, wherein said conductive band is constructed of metal foil at least one-half inch in width.

8. The apparatus of claim 4, wherein said anode and said cathode are generally planar elements.

* * * * *